United States Patent [19]

Mol et al.

[11] 4,236,856

[45] Dec. 2, 1980

[54] SHEET STACKING APPARATUS

[75] Inventors: Hans C. Mol, Wilton; Michael A. Brown, Norwalk, both of Conn.

[73] Assignee: Pitney Bowes, Inc., Stamford, Conn.

[21] Appl. No.: 48,296

[22] Filed: Jun. 13, 1979

[51] Int. Cl.[3] ..... B65H 31/36; B65H 33/06

[52] U.S. Cl. ..... 414/54; 271/207; 414/35; 414/900

[58] Field of Search ..... 414/35, 54, 59, 900; 271/184, 207, 223, 224, 225

[56] References Cited

U.S. PATENT DOCUMENTS

| | | | |
|---|---|---|---|
| 2,901,249 | 8/1959 | Dexter et al. | 414/59 X |
| 3,860,127 | 1/1975 | Fassman | 414/54 |
| 4,188,025 | 2/1980 | Gustafson et al. | 414/54 X |

FOREIGN PATENT DOCUMENTS

| | | | |
|---|---|---|---|
| 2804672 | 8/1978 | Fed. Rep. of Germany | 271/224 |

*Primary Examiner*—L. J. Paperner

*Attorney, Agent, or Firm*—Lawrence E. Sklar; William D. Soltow, Jr.; Albert W. Scribner

[57] ABSTRACT

The instant invention provides sheet stacking apparatus capable of stacking bundles of aligned sheets of paper in alternate, offset relation or alternate, skewed relation. The apparatus includes a storage bin for receiving a multiplicity of aligned bundles of sheets. The storage bin includes a bottom wall, a pair of side walls, front stopping members adjacent each of the side walls, and an adjustable, central post situated between the front stopping members. The apparatus also includes means for feeding the aligned bundles of sheets along alternate side walls of the storage bin. The post may be positioned closer than the front stopping members to said feeding means to effect alternate offset stacking or further away than the front stopping members from said feeding means to effect alternate skewed stacking.

6 Claims, 5 Drawing Figures

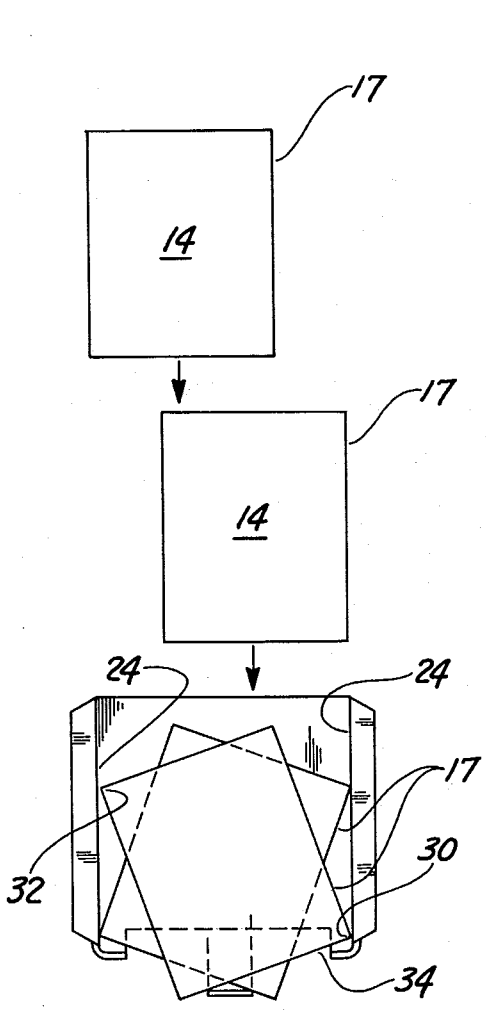
Fig. 5
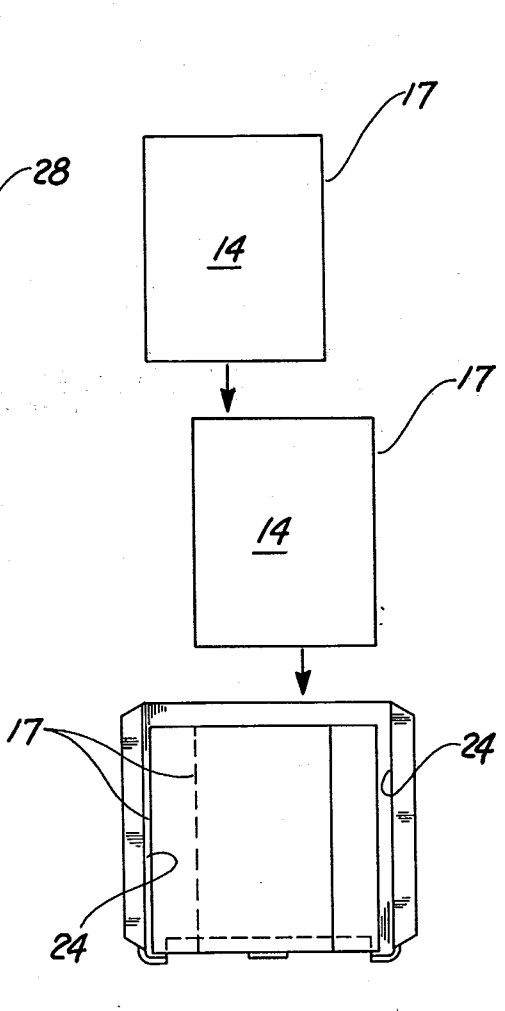
Fig. 4
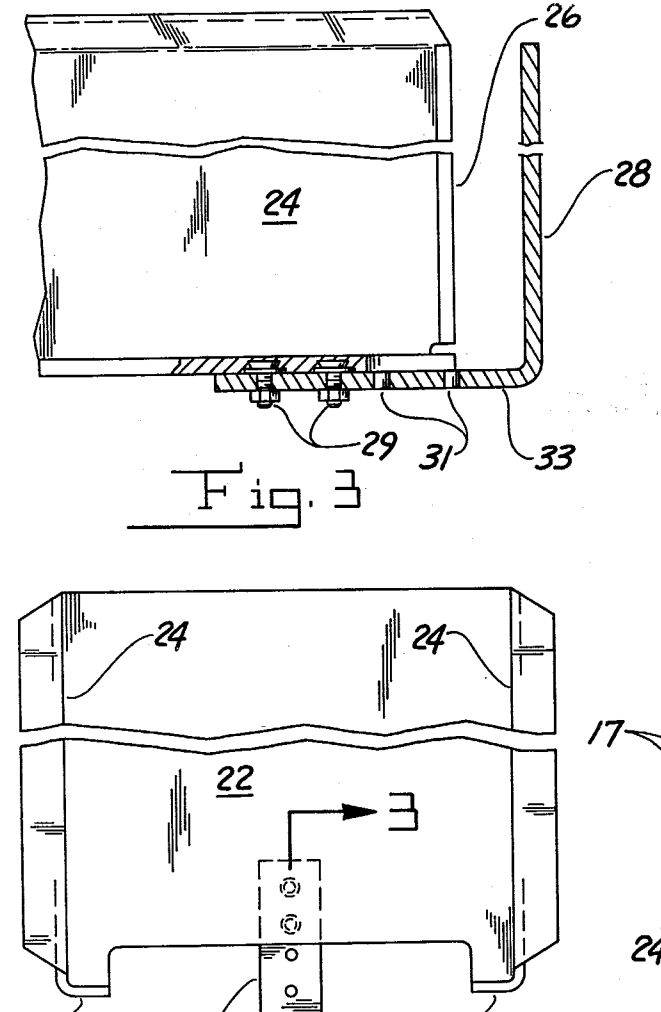
Fig. 3
Fig. 2

SHEET STACKING APPARATUS

BACKGROUND OF THE INVENTION

The instant invention relates to paper sheet joggers, and more particularly to apparatus capable of stacking bundles of aligned sheets of paper in alternate offset relation or alternate skewed relation.

It is a general practice, in the course of utilizing automatic collators, to employ joggers, which are large, complex mechanical structures, to register the edges of a stack of paper sheets thereby forming an aligned bundle of sheets. The aligned bundle of sheets are then typically stapled and discharged into a storage bin from which they are removed by an operator. In many applications of sheet joggers, it is desirable to have the bundles arranged in an alternating fashion, either skewed or offset, so that individual bundles are more easily identified and grasped. The prior art does teach apparatus for arranging bundles of sheets in alternate offset relation and other apparatus for arranging bundles of sheets in alternate skewed relation. However, the prior art does not teach any single apparatus that has the capability of stacking in either an alternate offset or alternate skewed relation.

SUMMARY OF THE INVENTION

Accordingly, the instant invention provides paper sheet stacking apparatus capable of stacking bundles of aligned sheets of paper in alternate, offset relation or alternate, skewed relation. The apparatus includes a storage bin for receiving a multiplicity of aligned bundles of sheets. The storage bin includes a bottom wall, a pair of side walls, front stopping, members adjacent each of the side walls, and an adjustable, central post situated between the front stopping members. The apparatus also includes means for feeding the aligned bundles of sheets along alternate side walls of the storage bin. The post may be positioned closer than the front stopping members to said feeding means to effect alternate offset stacking or further away than the front stopping members from said feeding means to effect alternate skewed stacking.

BRIEF DESCRIPTION OF THE DRAWINGS

FIG. 2 is a top plan view of the stacking apparatus seen in FIG. 1;

FIG. 3 is an enlarged, sectional view taken on the vertical plane indicated by the line 3—3 in FIG. 2;

FIG. 4 is similar to FIG. 2 but additionally shows sheets being fed to the stacking apparatus to be arranged in alternate, offset relation;

FIG. 5 is similar to FIG. 4 except that it shows sheets being fed to the stacking apparatus to be arranged in alternate, skewed relation.

DETAILED DESCRIPTION

Figure 1:
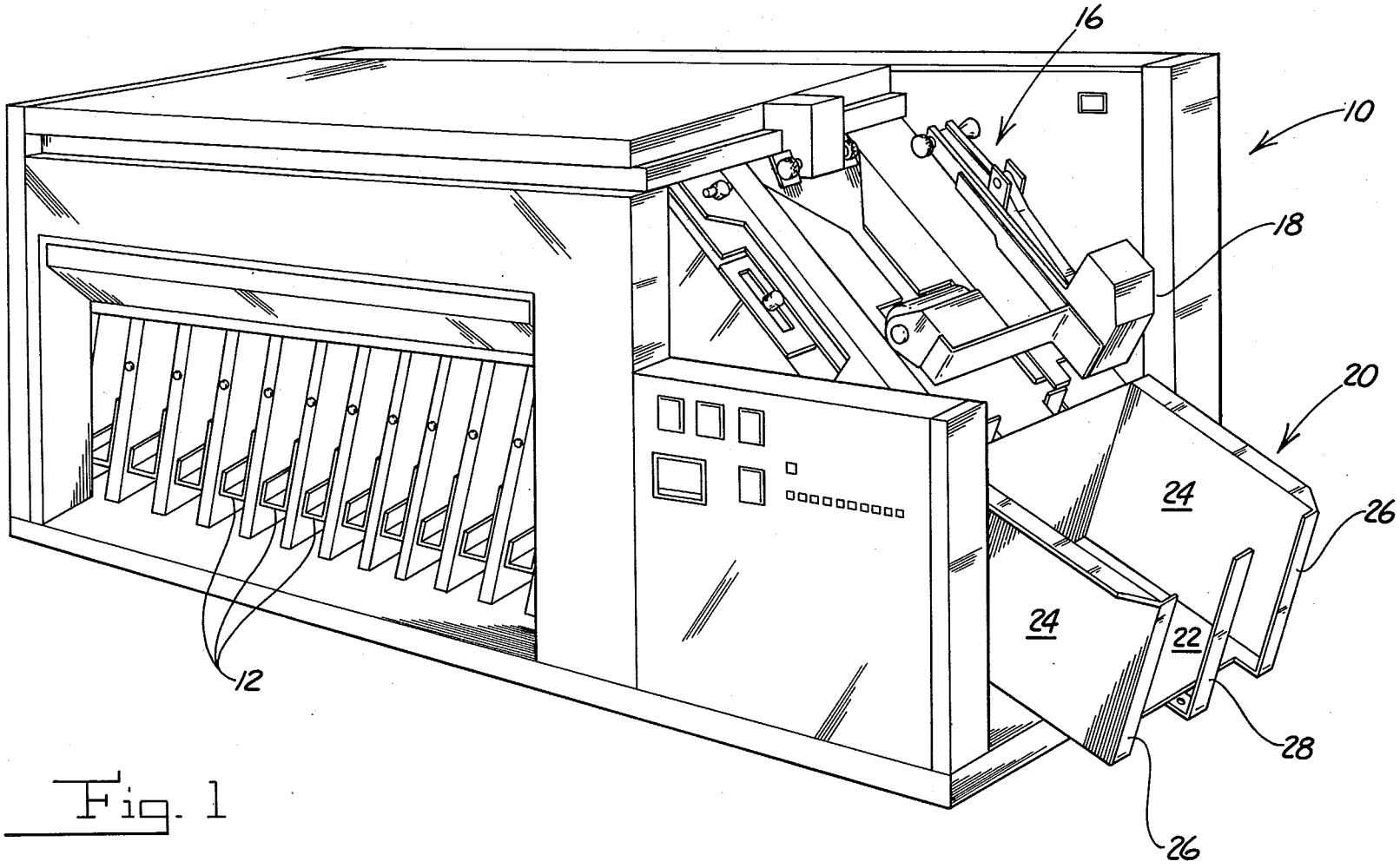
FIG. 1 is a perspective view of a collator equipped with a stacking apparatus according to the instant invention.

Reference is made to the drawings, wherein there is seen in FIG. 1 a collator 10 having a plurality of bins 12 from which sheets of paper 14 (FIGS. 4 and 5) are fed to a jogger 16. The sheets 14 are aligned by the jogger 16 into a bundle 17 which may then be stapled together by a stapler 18. The bundle 17, stapled or unstapled, is then dropped along alternate sides into a storage bin 20.

The storage bin 20 consists of a bottom wall 22, a pair of side walls 24, a pair of front stopping members 26 each adjacent to one of the side walls 24, and an adjustable, central post 28 situated midway between the front stopping members 26. The adjustable post 28 includes a supporting leg 33 and can be made to seat closer to the jogger 16 than are the stopping members 26, as seen in FIG. 4, or further away from the jogger 16 than the stopping members 26 as seen in FIGS. 2, 3 and 5 by means of a pair of pem studs 29 which extend through any adjacent pair of apertures 31 in the horizontal leg 33 and seat in the bottom wall 22.

The side walls 24 of the bin 20 are preferably adjustable with respect to the spacing therebetween and set about one to two inches further apart than the width of the paper sheets being processed. Naturally, the side walls 24 can be set further apart, if adjustable, to gain a greater clearance between a side wall 24 and the bundle 17.

To effect the alternate offset stacking shown in FIG. 4, the post 28 is moved inwards toward the jogger 16 so that the post 28 is preferably about $\frac{1}{4}$ to $\frac{1}{2}$ inch closer than the stopping member 26 to the jogger 16. The side walls are preferably set about one to $1\frac{1}{2}$ inches apart depending on the length of the paper, one inch being used for 11 inch long paper and $1\frac{1}{2}$ inches being used for 14 inch long paper. In the arrangement of FIG. 4, the bundle 17, in the course of being fed into the storage bin 20, first hits the central post 28 which halts further forward movement of the bundles 17. The post 28 is positioned on the center line of the collator 10, but slightly off-center in relation to the bundles 17. This arrangement causes the bundles 17 to bounce away from the center line, thus increasing separation of the bundles. Since the bundles 17 are fed alternately adjacent one of the side walls 24 and then the other, the bundles 17 would accumulate in the bin 20 in alternate offset relation.

To effect the alternate skewed stacking shown in FIG. 5, the post 28 is moved away from the jogger 16 so that the post 28 is preferably about $\frac{1}{2}$ to $\frac{3}{4}$ inch further away than the stopping members 26 from the jogger 16. The side walls 24 are preferably set about $1\frac{1}{2}$ to 2 inches apart depending on the length of the paper, $1\frac{1}{2}$ inches being used for 11 inch long paper and two inches being used for 14 inch long paper. The preferred spacing for the stopping members 26 is such that one of the stopping members 26 contacts the bundle 17 for about one half inch at one front corner 30 while the other front corner 30 misses the other stopping member 26 by about one half inch. In the arrangement of FIG. 5, the bundles 17, in the course of being fed into the storage bin 20, first hit one of the front stopping members 26 with a front corner 30 which causes the bundle 17 to effectively rotate about that stopping member until the diagonally opposite rear corner 32 contacts its adjacent side walls 24, at about which time the leading edge 34 of the bundle 17 contacts or almost contacts the post 28. Since the bundles 17 are fed alternately adjacent one of the side walls 24 and then the other, the bundles are rotated alternately about their two front corners so that the bundles accumulate in the bin 20 in alternate skewed relation. If a greater skewing effect is desired, it is only necessary to further separate the side walls 24 and to move the post 28 further away from the jogger 16.

Certain changes may be made in the above construction by those skilled in the art without departing from the scope and spirit of the invention. It is intended that all matter contained in the above description be interpreted in an illustrative rather than a limiting sense.

What is claimed is:

1. Sheet stacking apparatus capable of stacking bundles of aligned sheets of paper in alternate offset relation or alternate skewed relation, comprising:

a storage bin for receiving a multiplicity of aligned bundles of paper sheets, said storage bin having a bottom wall, a pair of side walls, front stoppng members adjacent each of said side walls, and an adjustable central post situated between said front stopping members; and means for feeding said aligned bundles of sheets along alternate side walls of said storage bin, and wherein said post may be positioned closer than said front stopping member to said feeding means to effect alternate offset stacking or further away than said front stopping members from said feeding means to effect alternate skewed stacking.

2. The apparatus of claim 1, wherein the feeding means comprises a jogger.

3. The apparatus of claim 1, wherein the side walls are adjustable with respect to the spacing therebetween.

4. The apparatus of claim 3, wherein the side walls are set about one to two inches further apart than the width of the paper sheets.

5. The apparatus of claim 4, wherein the adjustable central post can be set about $\frac{1}{4}$ to $\frac{1}{2}$ inch closer than the stopping members to the feeding means.

6. The apparatus of claim 5, wherein the adjustable central post can be set about $\frac{1}{2}$ to $\frac{3}{4}$ inch further away than the stopping members from the feeding means.

* * * * *